United States Patent [19]

Smith

[11] 3,933,247

[45] Jan. 20, 1976

[54] HIGH SPEED MAGNETIC CORE HANDLER

[75] Inventor: Nathan R. Smith, Blaine, Minn.

[73] Assignee: Micro Component Technology, Inc., Minneapolis, Minn.

[22] Filed: Dec. 14, 1973

[21] Appl. No.: 424,701

[52] U.S. Cl. ..... 209/73; 209/81 A; 324/34 MC; 209/74 M; 221/167

[51] Int. Cl.[2] ..... B07C 5/344

[58] Field of Search ..... 209/73, 81, 81 A; 221/171, 221/173, 200, 167; 198/33 AA; 324/34 MC

[56] References Cited

UNITED STATES PATENTS

| | | | |
|---|---|---|---|
| 2,796,986 | 6/1957 | Rajchman et al. | 209/81 R |
| 2,817,809 | 12/1957 | Stuart-Williams | 324/34 MC |
| 3,416,658 | 12/1968 | Goller et al. | 209/73 |
| 3,539,004 | 11/1970 | Baker et al. | 324/34 MC |
| 3,612,267 | 10/1971 | Eckert | 324/34 MC |

*Primary Examiner*—Allen N. Knowles

*Attorney, Agent, or Firm*—Schroeder Siegfried Ryan & Vidas

[57] ABSTRACT

An orientation system forms part of a magnetic core handling system using an oscillating feed cup causing magnetic cores to roll across an arcuate surface into a tapered slot and communicate with an index feed wheel. The index feed wheel has 50 slots formed around the edge thereof, each slot being in communication with a vacuum line to engage and hold the edge of the cores with the open center portion being exposed for testing. The index wheel is controlled without bounce through the use of a permanent magnetic stepping motor. The motor is controlled through four series of pulses for different field phases of the motor to control its movement. A single standard split pin probe is used for testing the magnetic cores and the probe does not come in contact with the core. A storage memory system is used to determine whether the core tested previously a plurality of slots from the accept or reject sorter determines the reservoir into which the cores will be collected. A detector is used on the probe drive mechanism to control the position of the index wheel.

18 Claims, 10 Drawing Figures

11
10
24
25
23
13
15
14
16
18
17
22
21
12
36
37
70
42
47
71
75
72
74
73
30
34
38
27
26
20
33
28
41
32
50
51
35
42
53
43
44
40
45
56
57
61
62
63
55
54
60
64
67
65
REJECT
68
ACCEPT
18
66

HIGH SPEED MAGNETIC CORE HANDLER

This invention relates to the field of the testing of magnetic cores and particularly to the manner in which cores are collected, tested, and sorted.

The fabrication of ferrite memory cores has undergone many improvements which has considerably increased quality and reduced cost of the cores. Examples are multicavity presses for fabricating powdered cores as well as an entire process which forms the ferrite powder into a tape from which cores are punched. New firing techniques have also been developed including means for bulk firing of the cores and continuous belt kilns have all contributed to significant cost savings in the manufacture of cores.

As a result of the decreased cost in manufacture of the cores, the production testing of the magnetic cores has risen from approximately 30% of the over-all cost to nearly 50% of the over-all cost. The testing of cores over recent years has also been severly limited by the ability to handle the cores efficiently at high speeds. While various attempts have been made to increase the speed of testing the cores, the reliability has also suffered as the increased speed arose.

A number of the prior art core handlers made use of a bowl to feed the cores into an orienter in which the cores would then roll down a sloped track under the influence of vibration and gravity and would then be slid through a very narrow "chute". The chute would be used for transporting the cores from the orienting device to a test probe. The cores would move down the chute under the influence of gravity. The chute dimensions of such a system must be carefully selected so that the cores will stack with a minimum of stagger and yet have enough clearance to minimize stoppages in the chute due to foreign materials and irregular surface finishes. In fact, where the core has a diameter of 0.018 inches, the particle size of airborne contaminants will easily approach or exceed the clearance which is desirable for testing such cores. Coupled with the problem of contaminents and rough surfaces, is the size variation of cores produced in normal production which may exceed 0.0015 inches and thus a careful sizing and cleaning operation must precede any production testing. The extra steps required in this operation merely elevate the cost of producing an acceptable core because the operation does require expensive equipment and additional personnel and time.

In addition to the problems just enumerated, where a chute type feed system is employed, the probe usually enters the core through a small clearance hole in the chute positioned in a manner to spear the second core above the bottom of the chute. The lowermost core is generally supported by a movable element or ledge while the probe is inserted in the second core. Once the probe is in place the ledge is removed and the probe is required to support the weight of the cores in the stack. This action produces rapid probe wear. There may also be another problem because the cores are combined in the chute and generally must fall only under the influence of gravity and frequently the cores do not fall at a proper speed and are struck by the probe which usually damages the probe and requires its replacement. Wherever the probe is used to support the core during part of the cycle, there is an additional problem of ferrite dust buildup on the probe and the contacts working with the probe thus causing rapid wear to the probe and quite often contact failure.

Another approach to solving the problem is found in U.S. Pat. No. 3,539,004 which is assigned to the International Business Machines Corporation of New York and is entitled "Handling and Testing Miniature Magnetic Elements". The structure disclosed therein makes use of a relatively large index wheel with 20 locations for magnetic cores. There are 20 probes each with its associated probe alignment mechanisms, bearings, springs, and cam followers, the cam being stationary in an overhead position. It should be kept in mind that each of these parts going into this machine must have extremely close tolerances because each probe must find its way into a core with only a 0.0015 inches to 0.002 inches clearance. The entire index wheel with 20 probe assemblies comprises a rather large inertial mass to index at the required speed and still come to a complete stop at a test station. For this reason, a wiping contact arrangement must be used with the equipment. The contact arrangement requires the use of special "twisted" probes which are extremely difficult and expensive to manufacture by comparison to a standard probe. The probe diameter can only be 0.008 inches for a core having a diameter of 0.018 inches and it may even be impossible to design a probe for smaller cores.

In addition to the problems associated with the manufacture of the equipment, the output signal of a probe is extremely small. Signals as low as four millivolts must be measured with an accuracy of plus or minus 0.2 millivolts. Using 20 probes simultaneously, all terminating in the same set of contacts produces a possibility of 20 times the error which might occur in a single probe and thus the reliability decreases substantially.

Examples of the former type of core handling equipment are found in U.S. Pat. Nos. 3,589,512 and 3,731,796.

The present equipment eliminates the disadvantages which have been found in the prior art. The present invention finds its embodiment in an orientation mechanism which makes use of an oscillating feed cup causing the cores to roll across an arcuate surface into which a tapered slot is formed where the slot is generally smaller than two core diameters. An index feed wheel is in communication with the tapered slot and the cores are brought into communication with an index wheel which has 50 slots equally spaced around the periphery of the index wheel. By feeding the cores to the index wheel in this manner, the channel or opening permitting the cores to move from the feed cup to the index wheel are unaffected by any airborne contamination. The index wheel delivers each core to a test probe accurately and reliably and the slots formed in the index wheel can be made with sufficient slot dimensions so that different size cores may be tested by the same equipment. It would also be obvious that the step of sizing and cleaning the cores has been eliminated.

Indexing of the wheel is accomplished through use of a modified permanent magnet stepping motor and control circuitry to provide a current pulse series to the motor to effectively accelerate from stop, de-accelerate, and then break to a stop at a new index position. It has been found that the accuracy of the index system is less than two minutes of arc and is nonaccumulative. Because the indexing system is this accurate, the use of a single standard split pin probe may be used.

Even if the core should be struck by the probe during the testing action, the worst that would most likely be encountered is that the core would be pushed from the wheel causing no probe damage. Because the probe does not come into contact with the core, the problem of ferrite dust buildup is practically eliminated. A memory system is used through means of a logic circuit and shift register to memorize the system and condition of each core tested after leaving the test station so that the core upon reaching the sorting station may be properly accepted or rejected. The equipment is operated in a fail-safe condition, that is, unless a signal is applied to a solenoid to move the sorting vane, the cores will be rejected.

It is therefore a general object of the present invention to provide an improved structure and method of sorting magnetic cores for use in digital computers.

It is a more specific object of this invention to provide a sorting system unaffected by nominal airborne contaminants of magnetic cores to eliminate a cleaning and sizing operation.

It is yet another object of this invention to provide means of testing magnetic cores by bringing a single core into position for testing through the means of an indexing core carrier.

It is another object of this invention to improve the probe life of the equipment and yet test cores at a high rate of speed.

It is still another object of this invention to provide means to protect the position of an index wheel before movement of a test probe.

It is a further object of the present invention to drive a test probe through two consecutive cores for each revolution of a cam driving the same.

It is still another object of this invention to provide equipment to remember the position and condition of a magnetic core after testing it to reject or accept the same.

It is a further object of this invention to control an index wheel through the use of four pulse phases to drive a motor connected to the wheel.

It is yet another object of this invention to provide a testing mechanism using a fail-safe technique.

It is still another object of this invention to provide for accepting a plurality of test levels to collect cores showing premium specifications.

These and other objects and advantages of the invention will more fully appear from the following descriptions, made in connection with the accompanying drawings, wherein like reference characters refer to the same or similar parts throughout the several views, and in which.

MECHANICAL SYSTEM

Figure 1:
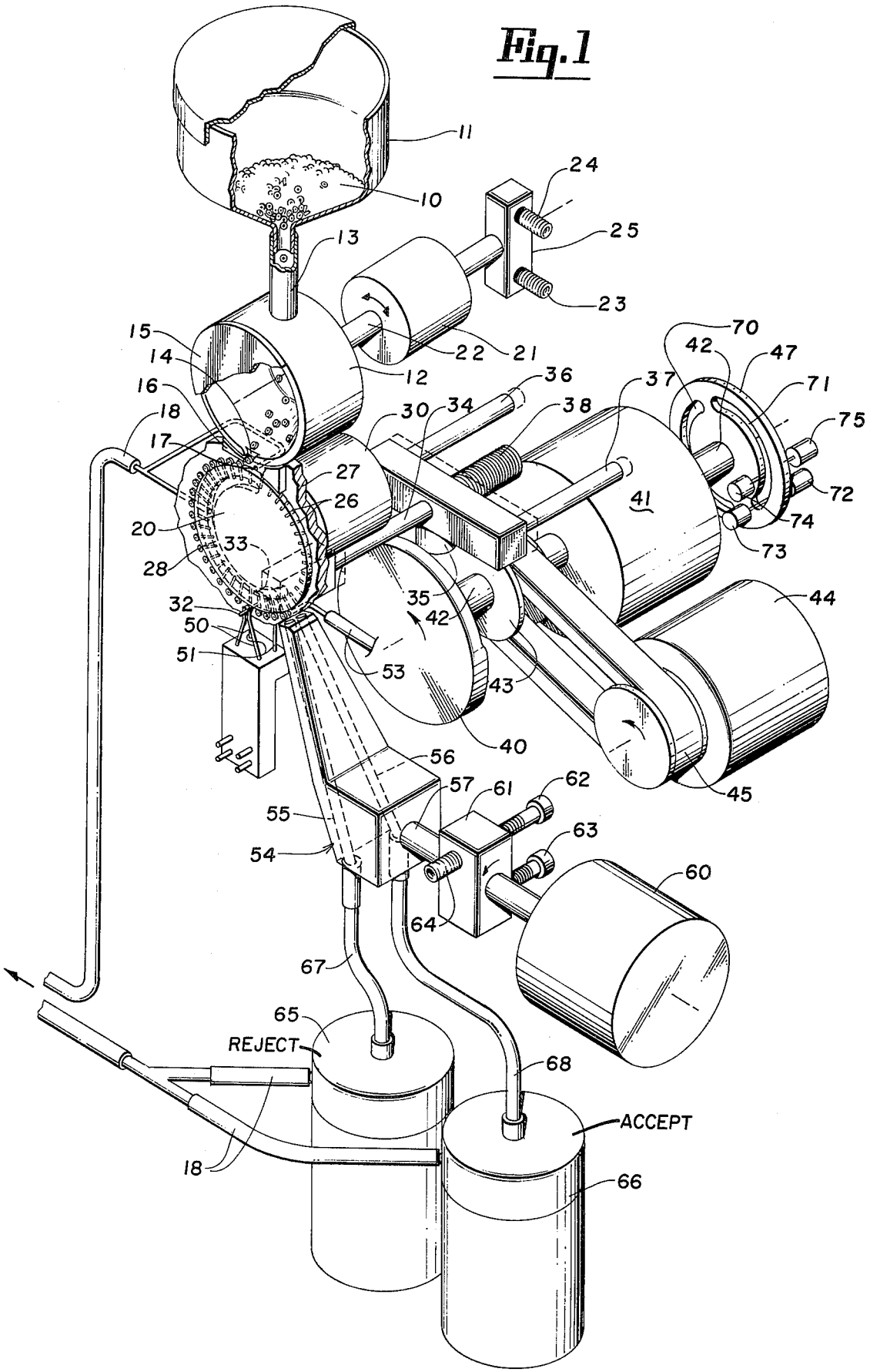
FIG. 1 is a schematic representation of a magnetic core handling system embodying the present invention.

Magnetic cores 10 to be tested are placed in a feed reservoir 11. The feed reservoir is connected to a feed cup 12 through a flexible conduit or hose 13. Natural machine vibration from the equipment is sufficient to maintain an adequate flow of the magnetic cores 10 from the reservoir 11 to the feed cup 12. The feed cup 12 is internally sloped from the back to the front with the front terminating in a lip 14 at the front edge of the feed cup 12. A feed cup cover 15 is placed over the cup and the lip to form an opening into an orienter 16. The orienter is made of two carbide slabs bonded to a stainless steel insert. The slabs are spaced to provide an opening slightly larger than the core diameter and are tapered from top to bottom to ensure rapid single filing of cores from the feed cup openig 14. A sliding cover (not shown) is provided to hold the single file cores in position. The orienter is supplied with a vacuum outlet 17 located below and to the right of the slot formed by the carbide insert 16. The vacuum outlet is connected to a vacuum source (not shown) through a conduit 18. The vacuum is used to assist in the feed operation and also to ensure that each core is drawn to the right to be picked up singly by an index wheel 20 which will be described shortly. Cores are supplied from the feed cup through the orienter 16 by an oscillating motion of the feed cup causing those cores which are in effect standing up on their edge to roll back and forth over the carbide slabs of the orienter. The oscillating motion is produced through a stepper motor 21 used as a rotary solenoid in the instant application. One such stepper motor is a Model 11RO1 manufactured by Computer Devices of Santa Fe Springs, Calif. Feed motor 21 is connected to feed cup 12 through a shaft 22. At the rear of the motor, a pair of spring stops 23 and 24 limit the travel of the feed cup by limiting the rotational travel of shaft 22 through a cross arm arrangement 25. Thus the travel of the feed cup is limited and the function of springs 23 and 24 return the motor to its other rotational position and thus there is created a vibrating source. In other words, when the feed motor 21 is energized, feed cup 12 is rotated counter-clockwise compressing stop spring 23 and when the motor is de-energized, the spring 23 pushes the feed cup clockwise until the cross arm or stop vane 25 compresses spring 24 resulting in a damped vibration. In this manner, producing energizing pulses to feed motor 21 results in a combination of oscillatory and vibrational motion to effectively feed the cores through the opening in lip 14 at an adequate rate.

Figure 6:
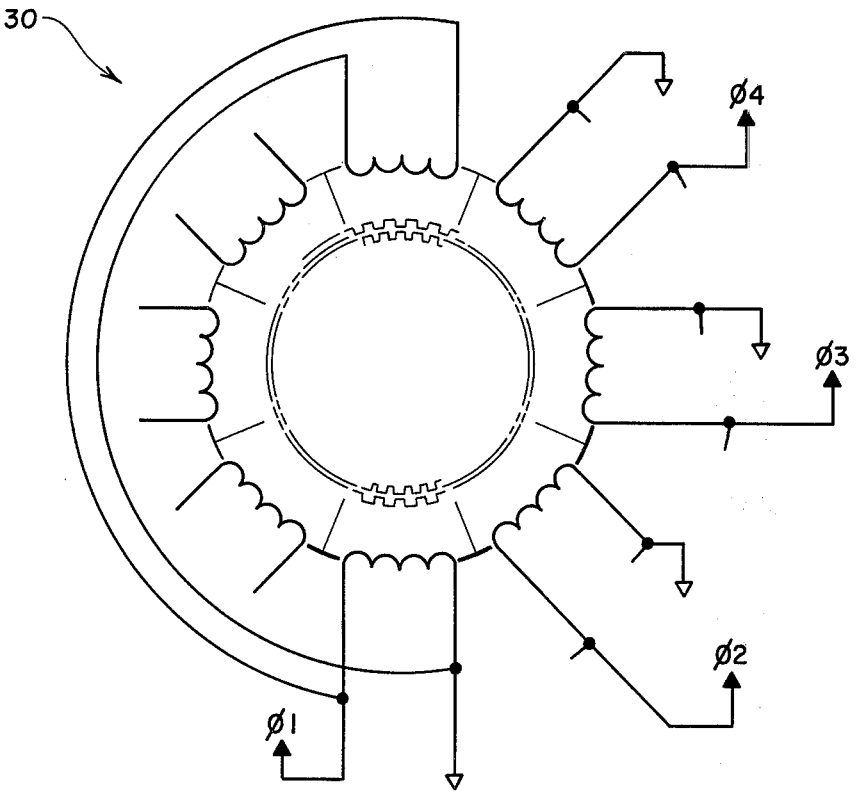
FIG. 6 is a schematic representation of a four phase stepper motor used as an Index Motor in the present invention.

Index wheel 20 contains 50 radial slots 26 which are equally spaced around the periphery of index wheel 20. Disposed behind disc 20, is a back plate 27 which contains a semi-circular groove 28 formed therein which communicates with the slots 26 formed in index wheel 20. Groove 28 is connected to the source of vacuum through vacuum line 18. The groove encompasses the rotational position where cores 10 are picked up from the orienter and extends slightly beyond the rotational position where the cores are removed from index wheel 20. For a more detailed disclosure of this particular structure, reference is made to FIG. 1A. The index wheel 20 is secured to index drive motor 30 through a hub and shaft held in place by a knurled nut assembly 31. Referring briefly to FIG. 6, index drive motor 30 is shown as a four phase, 200 step per revolution precision stepping device. One such structure which is presently manufactured is a Model 23H05 stepping motor manufactured by Computer Devices of Santa Fe Springs, Calif. The stator is designed so that it contains 40 poles, in other words 20 diametrically opposed poles. On the other hand, the rotor is formed of a magnetic core which includes some 50 poles or 25 diametrically opposed miniature magnets. The stator also contains 8 field windings, the opposing fields being connected so that in effect there are four phases which includes dividing each phase into diametrically opposed groups of five poles or "teeth". In other words, because the stator contains 40 such poles and the rotor contains 50 such poles, there is 1.8° difference between the opposed and adjacent magnetic poles and thus when the motor is pulsed to cause a movement, each step of the motor will then encompass 1.8°. When phase 1 is energized, a vacuum slot 26 in index wheel 20 is aligned with the orienter and another slot 26 appears 180 degrees from that aligned with the orienter and this slot is aligned with a test probe 32. Phase 1 occurs 50 times per revolution. Consequently, there are 50 vacuum slots 26, in index wheel 20. Phases 2, 3 and 4 are used in a unique manner to accomplish rapid indexing and stopping of the index motor without producing a bounce in the rotation. As will be explained in more detail, with respect to the logic circuit controlling index motor 30, upon receipt of an index command, phase 1 is turned off and phase 2 is turned on and left on long enough to overcome the inertial load and allow the index wheel 20 to attain sufficient velocity to pass through the phase 2 position. Phase 3 is then energized for a short period of time and rapidly accelerates the index wheel 20 into the phase 4 position. Phase 4 is then energized and remains on for a sufficient time to retard or slow the velocity of index wheel 20 as it moves toward the next phase 1 position. Phase 1 is then re-energized and attempts to lock the index wheel at the new phase 1 position through the magnetic orientation of the poles within the motor. Phase 4 is also re-energized at this time and fully brakes the index wheel 20 to bring it to a zero velocity at a phase 1 position. At that time, phase 4 is then turned off and phase 1 remains energized until the next index command is executed.

Probe 32 is part of a probe mechanism which includes a probe adapter 33, a probe shaft assembly, 34, a cam follower bearing 35, a pair of alignment shafts 36 and 37, and a spring retainer and 38. Probe shaft assembly 34 carries the probe adapter 33 at its forward end which contains the probe 32. Cam follower bearing 35 is attached to probe shaft assembly 34 by a suitable means such as a shoulder screw and the entire assembly is guided for lateral motion by a pair of alignment shafts 36 and 37. The entire assembly is spring loaded through a compression spring 38 and probe assembly 34 engages two nylon stops (not shown) when the probe is in its most forward position.

The probe shaft assembly 34, is driven by means of an open faced double lobed cam 40. In other words, for each rotation of cam 40 the probe is cycled twice. In operation, the probe shaft assembly 34 will rest against the two forward stops and in this position, the cam follower bearing 35 will ride loosely on the low dwell portions of the surface of cam 40. This design ensures that the probe will have zero motion during the test cycle and also guarantees long mechanical life and low noise operation of the drive mechanisms. The cam, because of its relative lightness may have a tendency to be slowed in its rotational movement at the time the cam follower bearing 35 engages a lobe portion of cam 40. To overcome this tendency to slow down, cam 40 is connected to a fly wheel 41 by a shaft 42 which has a pulley 43 intermediate the fly wheel and cam. The pulley 43 is driven by a 115 volt Bodine motor 44 through a connecting belt 45. The motor speed is controlled by a Bodine Model 911 controller 46 (FIG. 3B) by normal means such as a speed control potentiometer. The drive line pulley ratio is 1 to 1.5 and with a motor speed from zero to 2,250 rpm, the drive line speed of the cam may then reach 1,500 rpm, and through the use of its two different lobes, the handler can then test cores up to a speed of 3,000 cores per minute. Because the magnetic core handler speed is variable over a wide range, all mechanical functions are related to the position of ccam 40 and this is accomplished through the use of a double aperture timing disc 47 which is connected to shaft 42. As seen further in FIG. 3B, the motor speed controller uses a 110 volt alternating current input and the controller regulates the direct current voltage supplied to the field and armature windings of motor 44. The actual control of motor 44 is accomplished through a relay K1 which upon being energized, breaks the supply voltage to the feed control 46. The conditions under which relay K1 is energized will be explained further in the discussion of the logic control circuit.

Figure 1A:
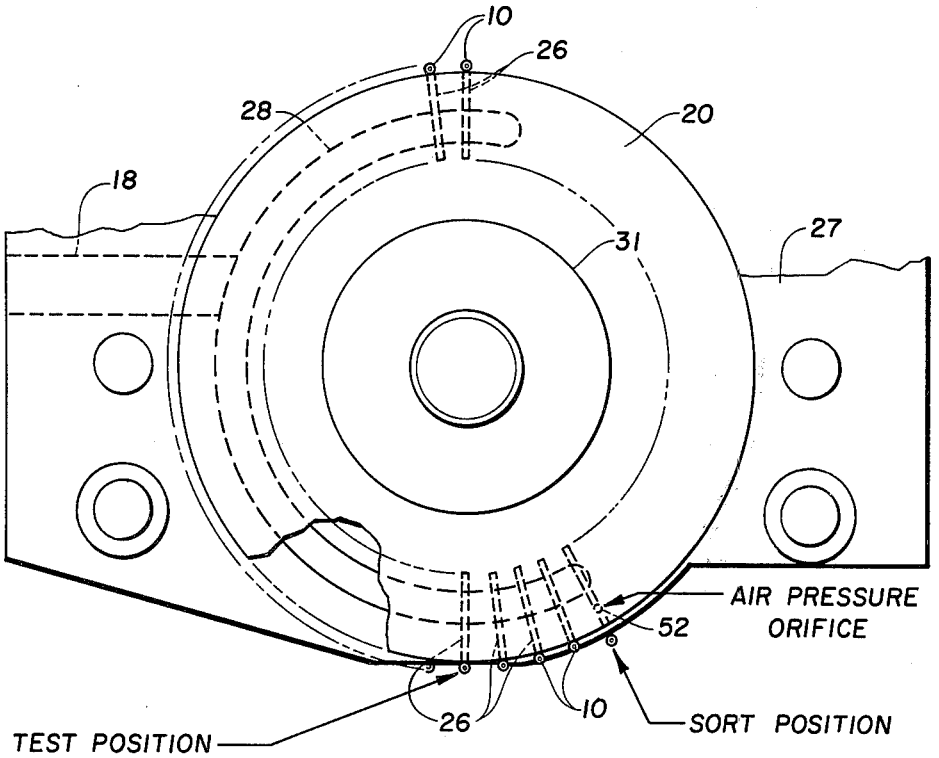
FIG. 1A is a detail view of an index wheel used to transport the magnetic cores from a first position to a final position.

Probe 32, upon being driven forwardly, passes through a core 10 and engages a pair of spring loaded contacts 50 and 51, which for the purposes of disclosure will not be shown in any more detail than that found in FIG. 1. Each core 10 is held in its particular index slot by means of the vacuum during the testing procedure. After the test is completed, the core must then be released from the index slot and sorted into an Accept or Reject category. If the sort system is to be reliable, the core must be released accurately, positively, and rapidly. For these reasons, the core is retained by vacuum at its index slot for an additional four index cycles after the test has been completed at the test position (See FIG. 1A). In the fourth position, the index slot stops adjacent to a pressurized air orifice 52 formed in back plate 27. The orifice is supplied through a conduit 53 that is connected to a source of air pressure (not shown). In this fourth position, as the index slot 26 stops over the pressurized air orifice 52, the core 10 is positively ejected into a previously selected conduit.

A sort vane 54 is positioned at an angle of approximately 30° from the vertical beneath index wheel 20 at a location some 4 slots downstream from the test position or some 28.8° therefrom. Sort vane 54 contains a pair of conduits or passageways which are respectively the "reject" passageway 55 and the "accept" passageway 56. Passageways 55 and 56 are aligned with the trajectory of an ejected core so that they will be collected properly. Sort vane 54 is attached to a shaft 57 of a stepping motor 60 which is used as a rotary solenoid. Attached to shaft 57 is a stop vane 61 which is fitted with two energy absorbing stops 62 and 63. stops 62 and 63 restrict the bounce of the vane as it is moved from one position to another. A selector bias spring 64 is secured to stop vane 61 in a position to bias the reject orifice and conduit 55 of vane 54 into position beneath the core to be ejected. When stepper motor 60 is energized, the lower stop 62 positions vane 54 to accept the core through conduit 56. It should be noted that when sort vane 54 is in the reject position, the accept orifice and conduit 56 is located beneath back plate 27 in a position where a core 10 cannot accidentally enter this orifice. Two screws associated with stops 62 and 63 are used to adjust the position of the two sort orifices and conduits 55 and 56 to appear in the proper lateral position to intercept.

A pair of receptacles 65 and 66 are connected respectively to passageways 55 and 56 through a pair of flexible tubes 67 and 68 respectively. Containers 65 and 66 are connected to the source of vacuum through one of the vacuum branch conduits 18. Each of the passageways are sealed so that there is created a vacuum flow within the chambers and their connecting passageways. The vacuum flow is set to approximately 5 cubic feet per hour in each passageway. It has been found that less flow would result in turbulence at the sort orifices and a greater flow of air would impart excess velocity to the sorted cores. The Accept or Reject decision from the test system is stored in a digital shift register and the information in the register is shifted each index cycle to correspond with the position of the index slot and this will be shown in more detail in a description of the logic circuits. Before turning to the logic circuits, it will be observed that timing disc or wheel 47 has a pair of arcuate shaped slots 70 and 71 formed therein which terminate at their ends to define a pair of spokes connecting the center portion of the wheel or disc to the outer rim portion. To aid in the timing cycle, a lamp 72 has a beam of light which extends generally through curved slot 70 and 71 to energize a photoelectric cell 73. It will be observed that the two portions forming the spokes, coincide with the low portions of cam 40. Timing is accomplished by means of detecting the position when the light is blocked from the index detector or photor cell 73 which corresponds exactly when the time probe 32 is withdrawn from a tested core. The output of the index detector 73 produces a high signal (plus 5 volts) when light is present and a low signal (gnd) when light is blocked at the positions corresponding to the lobes.

It is also a requirement that the electronic systems know when the probe 32 is inserted within the core and no relative movement takes place. This is accomplished through another photoelectric cell 74 which is energized through a lamp 75. Lamp 75 is on the same side of timing disc 47 as lamp 72 and photo detector 74 is on the same side of the disc as sensor 73. Photoelectric call 74 is approximately 30° counter clockwise from the position of photoelectric cell 73.

LOGIC CIRCUITS AND MOTOR DRIVE CIRCUITS

Figure 2:
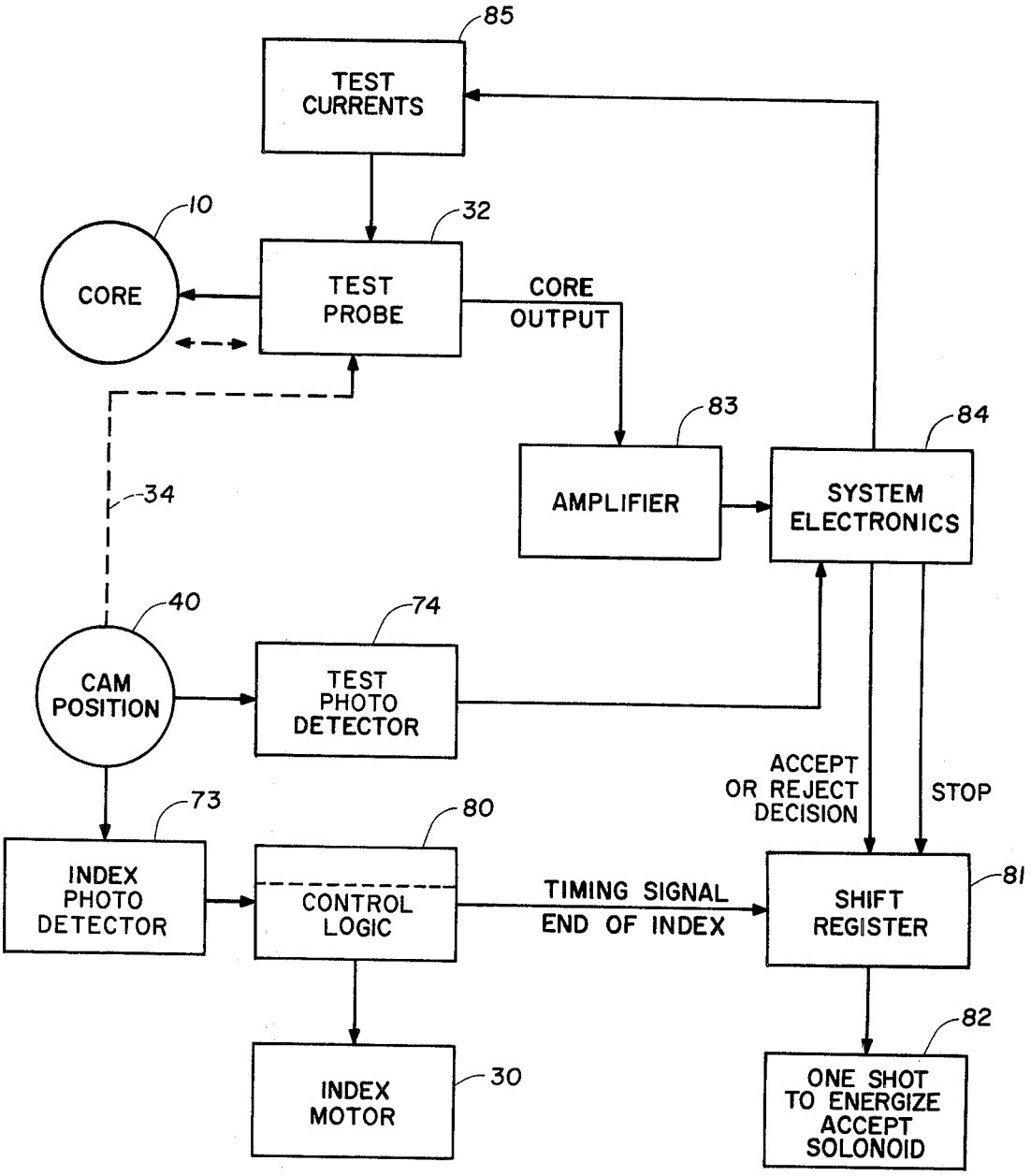
FIG. 2 is a block diagram showing generally the flow of data or signals to carry out the teachings of the invention.

Reference is now made to FIG. 2 which shows a block diagram of the logic circuits involved. It will be assumed that core 10 is held in a stationary position and that test probe 32 is in a fully retracted position. In this condition, light is blocked from index photo detector 73 indicating that cam bearing 35 is on a high lobe and that this is the end of the testing sequence and a timing signal is sent to the control logic circuit. The control logic is used to drive motor 30 and the end of the indexing sequence results in a signal being applied to a shift register 81. The shift register keeps track of each of the four positions of the previously tested core as the core is advanced from its test position to the position where it is to be ejected from the index wheel. Once the shift register reaches the third index position, a signal is applied to a one shot multivibrator to energize the accept solenoid. The one shot multivibrator is indicated generally as reference numeral 82. Once cam 40 reaches a position where the probe holder assembly 34 is at the lowermost portion on the cam 40, probe 32 enters the core to be tested and comes to a stop with respect to the core. The signal from test photo detector 74 is applied to the system electronics and the test currents are then generated as indicated by reference numeral 85, and the core output is then sent from the test probe to a differential amplifier 83 where the output of the differential amplifier 83 is applied to the system electronics 84. System electronics then determine whether the core is to be accepted or rejected and a signal of either acceptance or rejection is sent from the system electronics 84 to the shift register 81 and eventually to the one shot multivibrator to energize the accept solenoid. Should the system develop some malfunction, a stop signal may be applied from system electronics 84 to shift register 81 to stop the acceptance of any of the cores. In other words, they would all be placed in the reject container.

Figure 4:
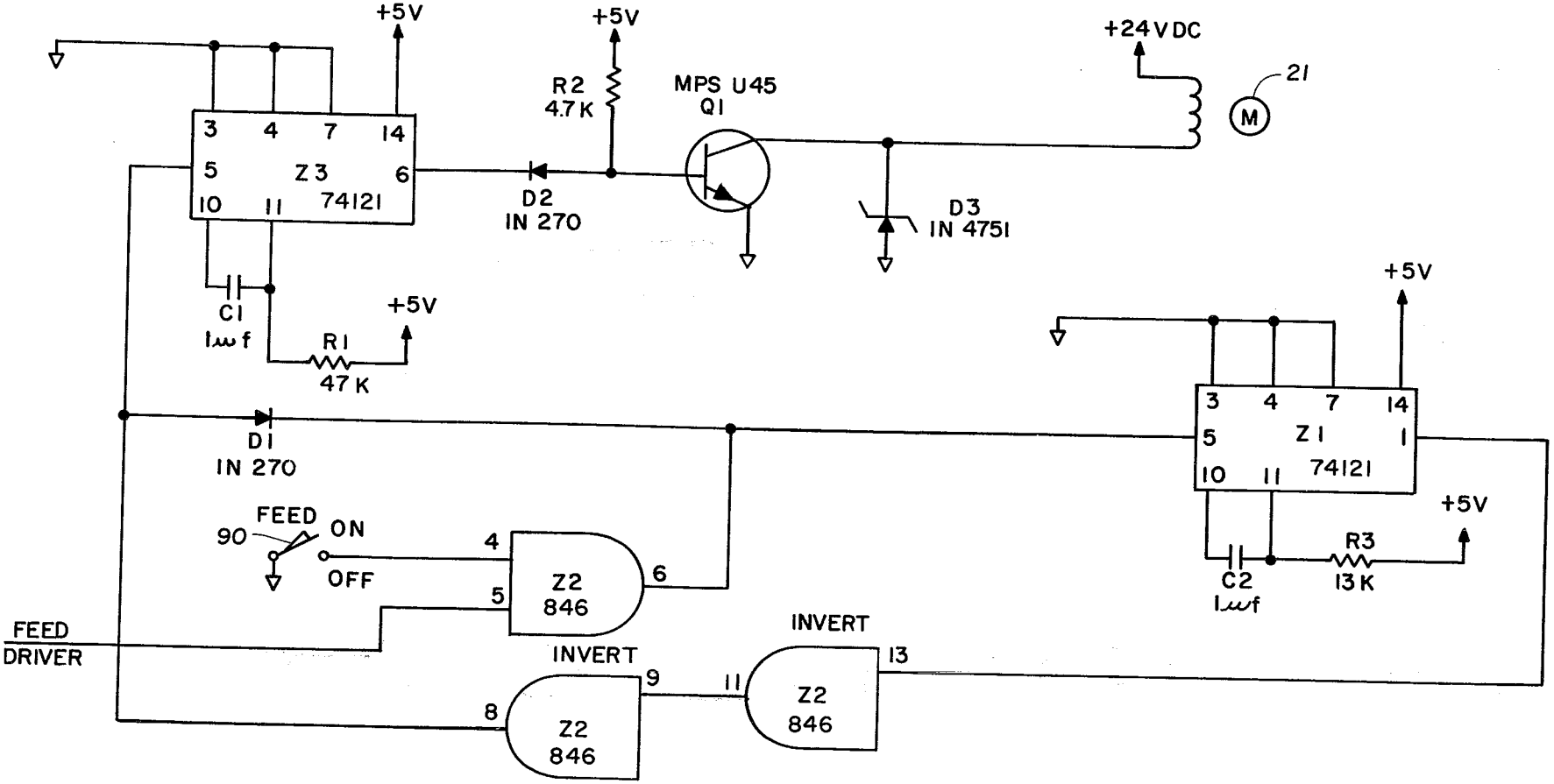
FIG. 4 is an electrical schematic embodying the drive circuits used with the Feed Motor of the magnetic core handling system.

Reference is first made to the feed motor drive circuit and this is shown in FIG. 4. Feed motor 21 is pulsed two times for each core handler cycle. Pulsing of feed motor 21 occurs only between index cycles so that no attempt is made to feed cores onto the index wheel while it is in motion.

The drive circuit consists of three integrated circuits and a transistor with associated circuit components. Integrated circuits Z1 and Z3 are mono-stable multivibrators (one shot multivibrators), and Z2 consists of three double input nand gates. Transistor Q1 has its collector connected to the field winding of feed motor 21. The other terminal of the winding is connected to a plus 24 volt dc supply.

Figure 3A:
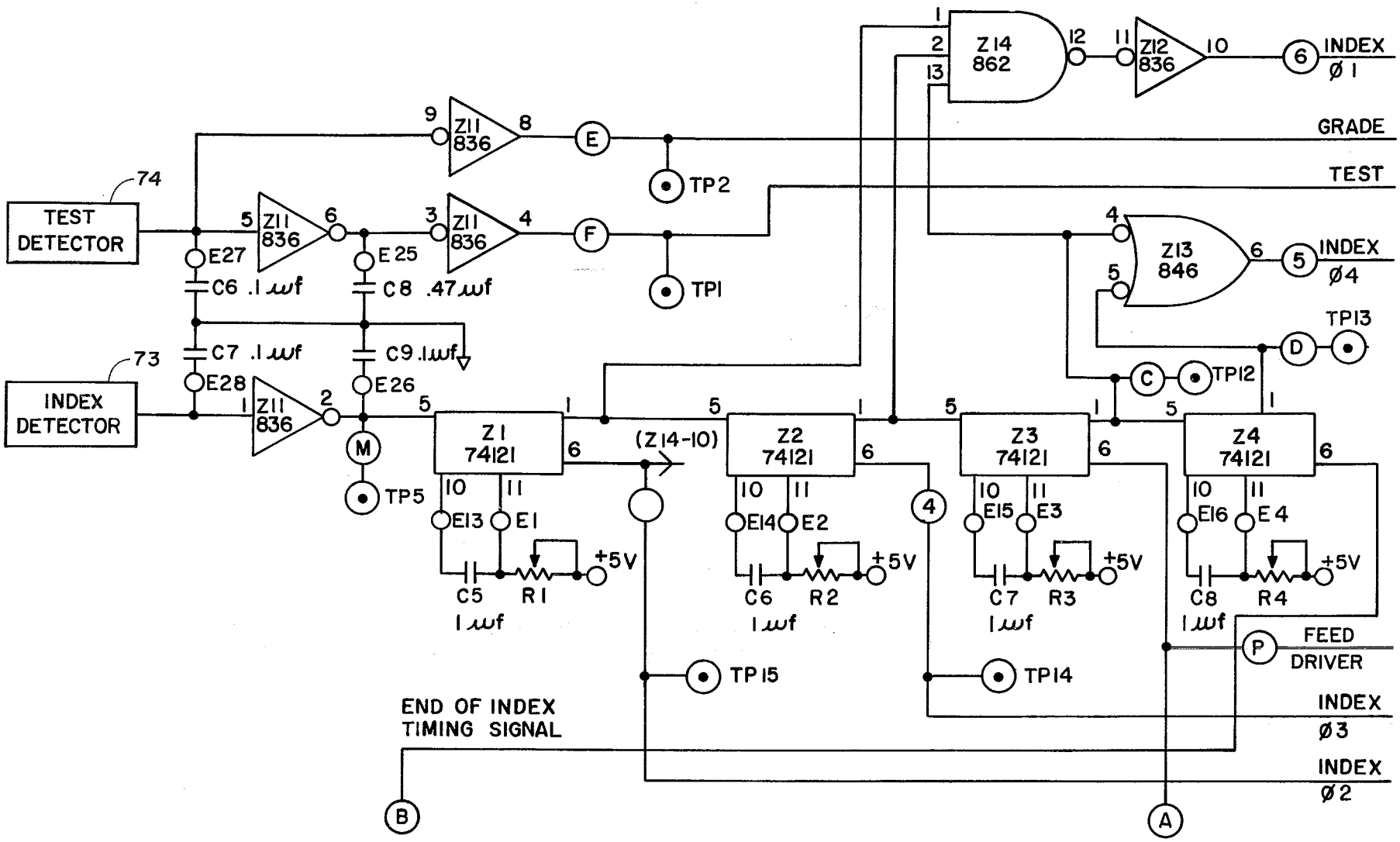
FIGS. 3A and 3B are electrical schematics embodying the logic system used in the invention.

Nand gate Z2 has an input at pins 4 and 5 and an output at pin 6 to form the input circuit for the feed drive motor. Pin 4 is connected to a feed switch 90. When the feed switch 90 is in the "on" position, Z2-4 is open (high) and pulses may be gated through Z2-5. When the feed switch 90 is "off", Z2-4 is at ground potential (low) and pulses at Z2-5 are inhibited. Z2 is an integrated circuit of the DTL Series, designated No. 846. Z2-5 is connected to a mono-stable multivibrator Z3-6 in the control circuit shown in FIG. 3A. Z3 in FIG. 3A is of the TTL Series integrated circuit and is of the type designated 74121. Z3-6 toggles at the end of each index cycle and applies a positive pulse of approximately 0.7 milliseconds to Z2-5 (FIG. 4). Z2-6 of the feed drive circuits will go low for this pulse duration and then back to a high condition. The positive going edge of this pulse is applied through diode D-1 to integrated circuit Z-3, also of the 74121 type. The signal is applied to pin 5 causing Z3 to toggle and when this happens, pin 6 will go high for approximately three milliseconds, the time determined by the RC time constant of C1 and R1 associated therewith. Integrated circuit Z3-6 going high will back bias diode D2 allowing current to flow from the plus five volt source through R2, to the base of Q1. Transistor Q1 will conduct current and thus complete the circuit, energizing feed motor 21. At the completion of the Z3 time constant, Z3-6 will go low, and D2 will become forward biased, cutting off transistor Q1 and the feed motor 21 will be de-energized. The inductive voltage spike caused by the collapse of the motor field winding will be limited by Zener diode D3.

The 0.7 millisecond pulse at Z2-6, in addition to triggering mono-stable circuit Z3, is applied to a similar integrated circuit Z1, also of the 74121 type. Thus Z1 is triggered essentially at the same time as circuit Z3. When this happens, Z1-1 will go low for approximately 8.5 milli-seconds and then return to its high condition. This positive transition is applied to Z3-5 through inverters Z2 at pins 13 and 11 and again at Z2 through pins 9 and 8, all of the Z2 inverters being of the 846 DTL Series explained earlier. D3 is thus toggled once again and feed motor 21 is re-energized for a second pulse. The two Z2 inverters are used to carry the pulse from Z1-1 so that it will not inhibit the first toggling of Z3. In this manner, the feed motor is pulsed twice at the completion of each index cycle.

Figure 3B:
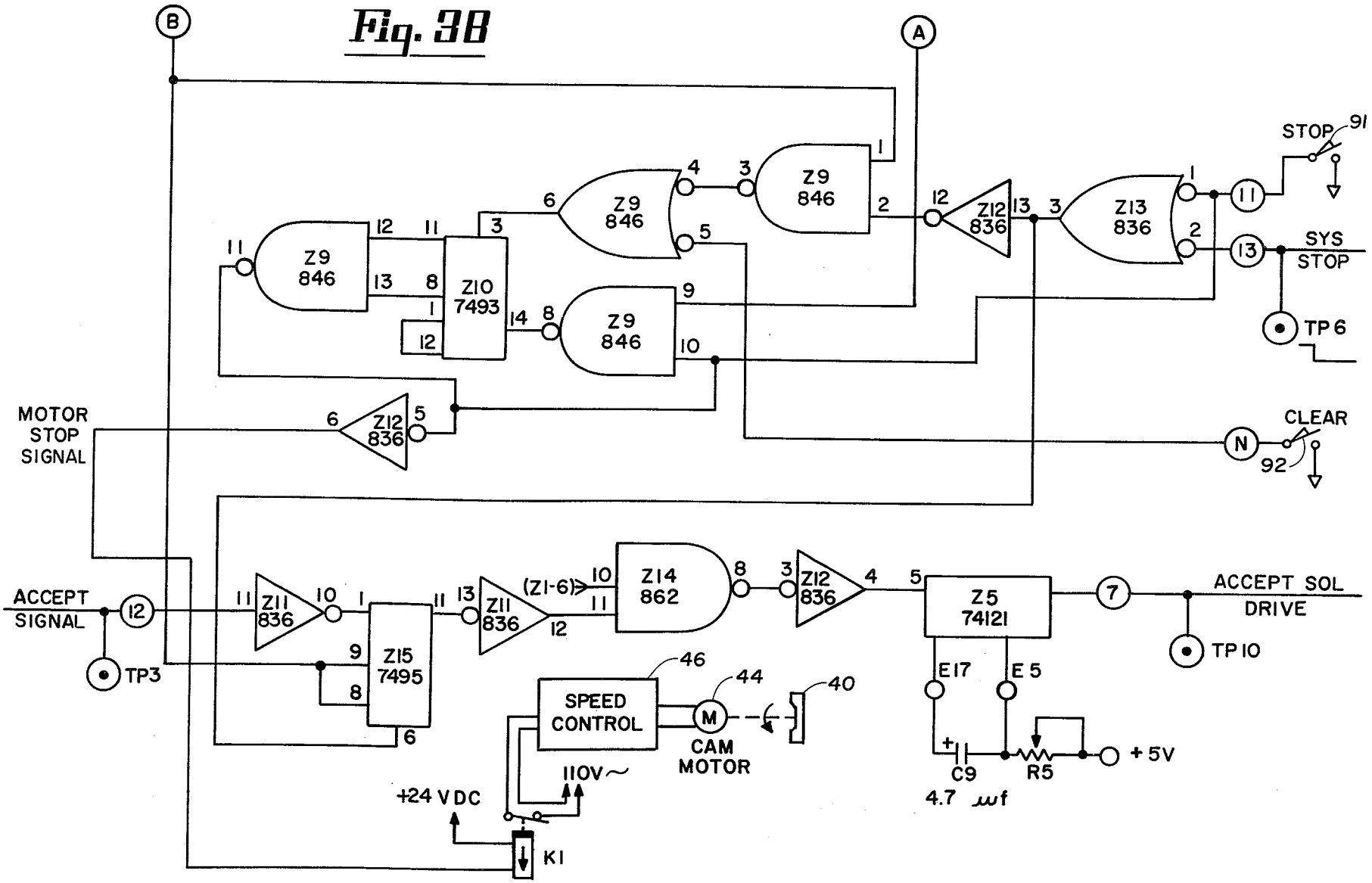

Reference is now made principally to FIGS. 3A and 3B. As explained earlier, timing in the system is accomplished by means of photo detectors and a timing disc 47 attached to the cam drive shaft 42. The motion of the index wheel 20 requires 5 milli-seconds and is timed to occur as soon as the probe 32 is retracted from the core previously under test. It should also be remembered at the output of the index detector 73 is high when light is present and low when light is blocked.

Figure 5:
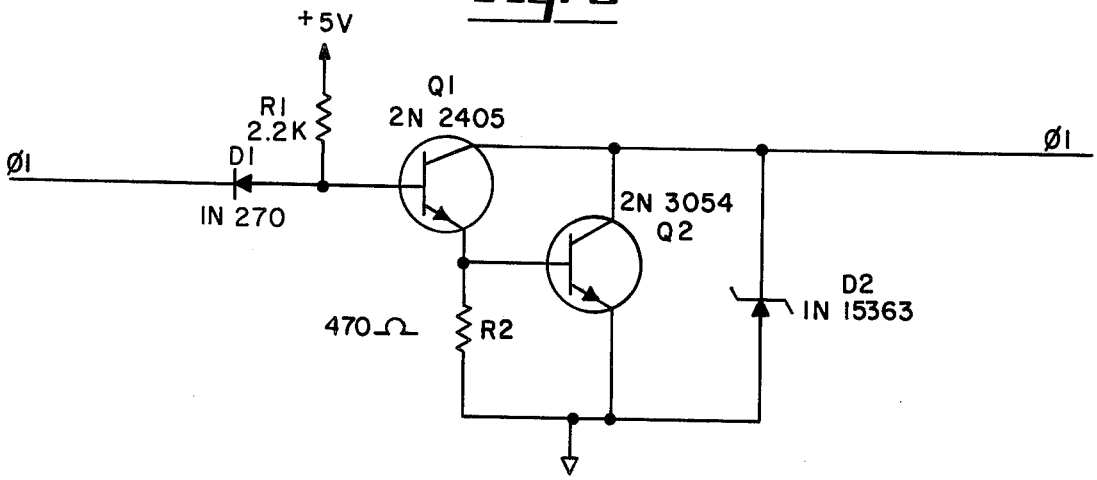
FIG. 5 is an electrical schematic embodying the drive circuit used in each phase of a four phase Index Motor used in the present invention.

Index detector 73 is connected to inverter Z11-1 which is of the DTL Series, No. 836. Z11-2 goes high when light is blocked and toggles one shot multivibrator Z1 of the TTL Series, No. 74121. Z1-1 goes low and inhibits nand gate Z14 at pin 1. Z14 is of the DTL Series, No. 862. This action turns off the phase 1 in which the index wheel 20 was in at the time the signal was received by index detectors 73. This condition happens because Z14-12 now goes high and Z12, and other DTL Series No. 836 goes low at pin 10 and biases diode D1 (FIG. 5). The base of transistor Q1 (FIG. 5) goes low and the Darlington amplifier pair of Q1 and Q2 will cease to conduct, de-energizing phase 1 and the Zener diode D2 will limit the phase 1 inductive back voltage. The signal output from FIG. 5 at phase 1 is connected to the phase 1 terminal of index motor 30 on FIG. 6. Z1-6 goes high and a phase 2 signal is applied to a second circuit which is identical to that in FIG. 5 which would ordinarily be designated with a phase 2 input and phase 1 output. The circuit would be operationally identical to that of FIG. 5 also. This second pulse continues for approximately 2 milliseconds determined by the time constant of C5 and R1 (FIG. 3A). Z1-1 then goes high while Z1-6 goes low and phase 2 is completed and one shot Z2 is toggled. Z2-1 goes low and continues to inhibit phase 1 through nand gate Z14-2. Z2-6 now goes high and phase 3 is energized through another diode and circuit like that in FIG. 5 which is connected to a phase 3 winding found in FIG. 6. The phase 3 windings are energized for approximately 1 milli-second being controlled by C6 and R2 forming a time constant for Z2. Z2 then resets and phase 3 is de-energized and the one shot multivibrator Z3 is toggled. Upon Z3-1 going low for approximately 1.5 milli-seconds, during which time it continues to inhibit phase 1 through Z14-13, it turns on phase 4 through nor gate Z13-4. Z14-6 is connected to another circuit identical to that of FIG. 5 which is connected to the windings of phase 4 of motor 30 as shown in FIG. 6. Z3-1 (FIG. 3A) now goes high and phase 1 is re-energized since all inputs of nand gate Z14 are high, and one shot multivibrator Z4 is toggled for approximately 0.7 milli-seconds. Z4-1 is also connected to nor gate Z13-5 and phase 4 is kept energized for another 0.7 milli-seconds.

Pulses at Z3-6 and Z4-6 are used as timing pulses for the control of the error counter, feed driver and sort logic.

Figure 7:
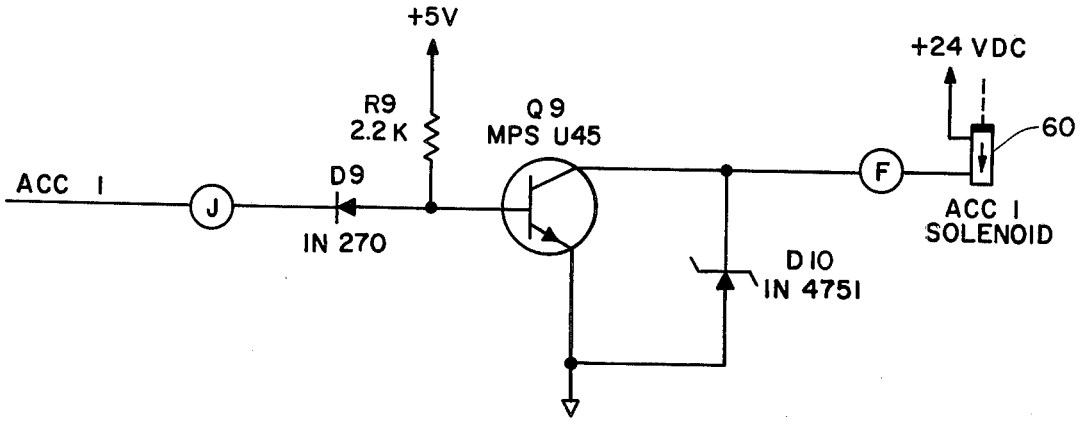
FIG. 7 is an electrical circuit embodying the drive circuit used with a Sort Solenoid to control the ultimate reservoir for a magnetic core tested in the present invention.

Upon receiving an accept signal such as sent from system elecronics 84, the signal will be received on pin 12 (FIG. 3B) to an inverter Z11, also of the DTL Series No. 836. The signal is then applied to a shift register Z15 of the TTL Series, No. 7495 at pin 1 thereof. The four stage shift register has pin 1 as the control input for stage 1 and pins 8 and 9 are the clock inputs. Pin 6 is a control input for all four stages. Signals present at pin 1 will be transferred to stage 1 when the clock input goes "high" (plus 5 volts). A "low" (gnd) condition at pin 1 indicates an accept and a high indicates a reject. A high condition on pin 6 will result in reject being entered into all four stages when the clock input goes high. It should also be noted that the shift register at Z15-6 is also connected to the output of Z13-3. This connection is made as a safety measure which automatically sets the shift register Z15 to a condition of reject when a stop command is received from the test system in the form of a low signal or through the closing of the handler stop switch 91. The clock input at Z15-8, 9, is produced from Z4-6 of the indexing circuits in FIG. 3. The pulse at Z4-6 occurs approximately 14 milliseconds after the end of the test. Z15-11 is the output of stage 3 of the shift register. A low signal on pin 11 indicates an accept core is present on the index wheel 20 at the third index position from the test position (see FIG. 1A). On the next index cycle, the core will move to the fourth position where an air stream will reject it from the index slot through the pressure orifice 52. At the beginning of the fourth index cycle, a pulse from Z1-6 will be gated through Z14-10 (FIG. 3B) causing one shot multivibrator Z5 to toggle. That signal is then applied to the accept signal input of the circuit in FIG. 7. When the input at J is high (an accept condition) diode D9 is back biased and current flows from the positive 5 volt source through R9 to the base of transistor Q9 causing the transistor to conduct. The conduction of transistor Q9 completes the circuit energizing accept solenoid or vane driving motor 60. The solenoid action causes the sort vane 54 to move to the Accept position in time to capture the core being ejected from position 4 of index wheel 20. Z5 is toggled for only 7 milli-seconds so the sort vane 54 is only in position long enough to receive the accepted core.

When Z5 resets, D9 becomes forward biased cutting off the conduction of transistor Q9. D10 id a Zener diode used to suppress the inductive back voltage of the sort motor winding or solenoid 60. The sort motor windings are connected to a 24 volt supply voltage.

Reference is now made to FIG. 3B and the circuits used to control the cam drive motor 44 and particularly when a manual or automatic stop is generated. A bindary counter Z10 is used in the form of TTL integrated circuit, No. 7493. The counter is decoded on pins 11 and 8 so that when pin 11 and pin 8 are both high, it indicates a count of 12 has been reached. The number 12 was chosen because it is relatively easy to decode, requiring only one gate to decode. When pins 11 and 8 both go high, then gate Z9 pins 12 and 13 are satisfied and the output 11 will go low, which is also coupled back to Z9-10. That condition of Z9 prevents any further pulses from going in on pin 14 of Z10. Pin 14 of Z10 is the clock input for the counter and pin 3 of Z10 is the reset input of the counter. Under the conditions just described, Z10 would be locked up after it has counted up to 12. Pin 9 of Z9 is connected to Z3-6, so it receives a pulse every time the mechanism indexes. In other words, every time the mechanism indexes, a count goes into Z10. After the count is applied to Z10, it will be seen that Z4-6 directs a signal to Z9-1. Z9-2 is normally high, so the signal is coupled through or gate Z9-4 to Z10-3 which is the binary counter reset input. Every time index Z3 applies a signal causing Z10 to count up, a Z4 pulse will reset Z10, and this happens every time an index signal is generated.

If it is desirable to generate a stop command signal, it may be received on Z13-1 or Z13-2. Either Z13-1 or Z13-2 going low makes Z13-3 high. A stop switch 91 may be closed to create the proper condition at Z13-1, or a system low signal may be received at Z13-2. The pulses are inverted going through Z12 and that condition would produce a low on Z9-2 to interrupt any more reset pulses from going into Z10. If the interrupting signal stays for 12 counts of 12 index cycles, then Z10 is going to count to 12. Under these conditions Z10-11 and Z10-8 will go high, the pulse on the output of Z9-11 will go low, couple back around to Z9-10 and hold it off. Z9-10 is also connected back to Z13-1 to insert a permanent stop command. The permanent stop command signal also passes through the run circuit, thus the whole circuit now becomes totally locked up. The output of Z9-11 provides a stop signal to the motor control unit through Z12-5 and 6. Z12-6 opens the circuit to relay K1 to remove the supply voltage to the speed control 46.

To make clear the circuits and start the operation again, a reset pulse is required at Z10-4. A low coming in on Z9-5 through the clear switch 92 will produce the desired result. Once the counters are clear, the circuit can function again.

Figure 8:
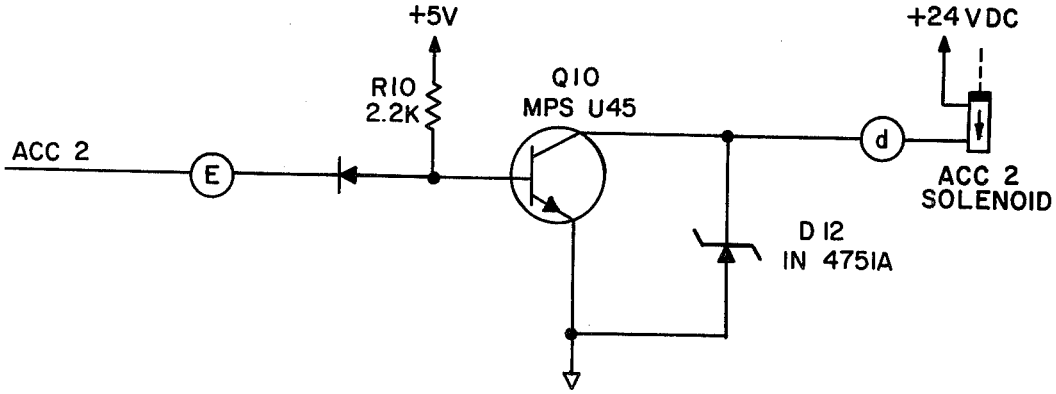
FIG. 8 is an additional electrical schematic embodying a drive circuit used with a Second Sort Solenoid to control the ultimate collection reservoir for a premium detected magnetic core tested.

For certain applications, it is desirable to select the premium tested cores. This is accomplished by adding another passageway to collector vane 54 and changing the position of a stop such as stop 63. Under such conditions, another selector motor such as selector motor 60 or a stepping solenoid would be used to change the position of the stop so that the accept condition would allow the selector motor 60 to rotate vane 54 an additional amount to a new slot and passageway. Under such conditions, the same fail-safe operation would be ensured and the circuit would operate much in the same manner as that described previously. For example, a new logic system such as found at the bottom of FIG. 3B would be used where the accept signal would indicate a core of higher quality and the three parallel signal paths would also be used with this circuit which are shown to be the output from Z13-3, the output from Z4-6, and the output from Z1-6. The output from the circuit such as Z5 would then be applied to a circuit such as found in FIG. 8 which would drive another solenoid, just described previously, which would be used to adjust the stop position for the rotational movement of vane 54. Another container like that of container 66 would be used with a flexible tube similar to that of 68 to direct the premium cores into the container. Of course the new container would also be connected to the vacuum source through a conduit means such as conduit 18.

Reference has been made to various types of integrated circuits and for a disclosure of such circuits, reference may be had to catalogs published by the manufacturers or speciaaty houses such as Signetics of 811 East Arques specialty Sunnyvale, Calif. 94086. Each of the integrated circuit blocks shown in the various figures have the accompanying transistor-to-transistor logic designations or the appropriate diode to transistor logic designations. The specifications for each of the integrated circuits describe in detail the internal operation of the integrated circuits.

While some reference has been made to test detector 74 (FIG. 3A) the associated circuits with the test detector are applied to the system electronics 84 which is directed to another portion of the equipment which has been omitted for simplicity in describing the present invention.

It will, of course, be understood that various changes may be made in the form, details, arrangement and proportions of the parts without departing from the scope of the invention which consists of the matter shown and described herein and set forth in the appended claims.

What is claimed is:

1. Magnetic core handling apparatus comprising:

a. moving means moving a plurality of magnetic cores to a retrieving station having an orifice larger than a single, but smaller than a double, diameter of said magnetic cores;

b. index wheel means having a plurality of core holding devices equally spaced around the periphery thereof, said wheel means operably communicating with said orifice of said moving means for consecutively retrieving a single core of said plurality and holding said cores;

c. magnetic core testing means disposed at a station downstream from said retrieving station for testing the magnetic characteristics of said magnetic cores;

d. intermittantly energized driving means operably connected to said index wheel means and thereby transporting said magnetic cores intermittently from said retrieving station to said testing station; and, e. controlling means connected between said driving means and said magnetic core testing means for controlling the intermittent movement of said driving means.

2. The structure set forth in claim 1 wherein said means for holding said cores is operable over only a segment of said index wheel means and said testing means is disposed within said segment for holding said cores.

3. The apparatus of claim 1 wherein said core holding devices of said index wheel means includes a plurality of radial passages formed therein extending to the outer periphery thereof, said passages communicating with a source of vacuum.

4. The apparatus of claim 1 including sort means having a plurality of selectable magnetic core collecting positions disposed adjacent said index wheel means and downstream from said magnetic core testing means.

5. The apparatus of claim 3 including conduit means disposed downstream from said testing station for conducting a stream of pressurized air between a source of pressurized air and an opening communicating with each of said radial passages in said index wheel means as they pass thereby.

6. A magnetic core handler comprising:

a. a magnetic core reservoir means adapted to receive and contain a plurality of magnetic cores and having a tapered orifice ultimately permitting only a single core to pass therefrom at any given time;

b. an indexing disc having a plurality of radial slots formed therein extending to the outer periphery of said disc and communicating with a source of vacuum over a segment of said disc mechanism, said outer periphery of said disc communicating with said orifice of said magnetic core reservoir means and adapted to receive and hold a magnetic core at each slot location;

c. a multi-phase motor drivingly connected to said indexing disc and having operable rotational positions representative of each phase between consecutive slot positions of said indexing disc;

d. a test probe adapted to be inserted within a magnetic core and produce a signal representative of an acceptable or rejectable core;

e. a probe driving mechanism moving said test probe into and out of core testing position, said probe driving mechanism including a detection device producing signals representative of a first and second position of said test probe;

f. a magnetic core sort mechanism having a plurality of selectable core collecting positions disposed adjacent said indexing disc and downstream from said test probe;

g. and electronic circuit means interconnected between said multi-phase motor and said detection device and said test probe and said magnetic core sort mechanism for controlling the rotational movement of said multi-phase motor and the position of said core sort mechanism with respect to said indexing disc.

7. The structure set forth in claim 6 wherein said multi-phase motor is a four phase stepping motor.

8. The structure set forth in claim 6 wherein said electronic circuit means includes first circuit means interconnected between said multi-phase motor and said detection device for controlling said sequences applied to said multi-phase motor and second circuit means interconnected between said first circuit means and said test probe and said magnetic core sort mechanism for controlling said rotational movement of said multi-phase motor and the position of said core sort mechanism with respect to said indexing disc.

9. A magnetic core handler comprising:

a. a magnetic core reservoir adapted to receive and contain a plurality of magnetic cores;

b. a feed bowl mechanism communicating with said core reservoir having an orifice permitting a single core to pass therefrom at any given time;

c. a rotatable indexing disc mechanism having a plurality of radial slots formed therein extending to the outer periphery of said disc mechanism and communicating with a source of vacuum over a segment of said disc mechanism, said outer periphery of said disc communicating with said orifice of said feed bowl mechanism, adapted to receive and hold a magnetic core at each slot location;

d. a four phase motor mechanism drivingly connected to said indexing disc mechanism and having operable rotational positions representative of four phases between consecutive slot positions of said indexing disc;

e. a test probe mechanism adapted to be inserted within a magnetic core and produce a signal representative of an acceptable or rejectable core;

f. a test probe driving mechanism moving said test probe into and out of core testing position, said probe driving mechanism including a detection device producing signals representative of a first and second position of said test probe;

g. first electronic circuit means interconnected between said four phase motor mechanism and said detection device and controlling the sequence of signals applied to said four phase motor;

h. a magnetic core sort mechanism having a plurality of selectable core collecting positions disposed adjacent said indexing disc and downstream from said test probe;

i. and second electronic circuit means interconnected between said first electronic circuit means and said test probe mechanism and said magnetic care sort mechanism for controlling the position of said core sort mechanism with respect to said indexing disc.

10. The structure set forth in claim 9 wherein said detection device includes mechanism supplying signal pulses representative of a rest position of said probe mechanism testing a magnetic core and a rest position of said probe out of the path of movement of said magnetic cores revolving on said indexing disc mechanism.

11. The structure set forth in claim 10 wherein said first electronic circuit means includes electronic counting means actuated by said detection device, said counting means generating four signals for energizing said four phase motor mechaism in rotating between consecutive slot positions.

12. The structure set forth in claim 11 including a pulsing motor operably connected to said feed bowl to produce an oscillating motion and electrically connected to said electronic counting means, said counting means generating signals for actuating said pulsing motor between generation of the last and first of said four signals for energizing said four phase motor.

13. The structure set forth in claim 9 wherein said second electronic circuit means includes electronic gating means actuated by said detection device, said gating means interconnected between said test probe mechanism and said magnetic sort mechanism for controlling said sort mechanism.

14. The structure set forth in claim 9 including a third electronic circuit means interconnected between said first electronic circuit means, said test probe mechanism, said probe driving mechanism, and said second electronic circuit means, said third circuit means including a binary counter having a first input controlled by said signals from said first electronic circuit means and having a second input controlled by said signals from said test probe mechanism, said binary counter receiving a reset signal from said second electronic circuit means and having an output controlling said probe driving mechanism.

15. The structure set forth in claim 14 including another circuit connected to said binary counter for clearing said counter.

16. The structure set forth in claim 9 including a sort control means having auxiliary motor means connected to said sort mechanism, said sort control interconnected between said second electronic circuit means and said first electronic circuit means and said test probe mechanism, for controlling said sort mechanism to another position.

17. The structure set forth in claim 4 including a plurality of receptacles, each of which has a core receiving conduit interconnected between said sort means and a vacuum conduit connected to a vacuum source.

18. The structure set forth in claim 17 wherein said magnetic core collecting positions include means for blocking movement of a magnetic core to a receptacle collecting cores representing an acceptable core.

* * * * *